United States Patent [19]

Kelley et al.

[11] 4,070,189

[45] Jan. 24, 1978

[54] SILVER HALIDE ELEMENT WITH AN ANTISTATIC LAYER

[75] Inventors: Richard Norman Kelley, Fairport; Gerald Allan Campbell, Webster, both of N.Y.

[73] Assignee: Eastman Kodak Company, Rochester, N.Y.

[21] Appl. No.: 729,554

[22] Filed: Oct. 4, 1976

[51] Int. Cl.[2] ..... G03C 1/78; G03C 1/96

[52] U.S. Cl. ..... 96/87 A

[58] Field of Search ..... 96/87 R, 87 A; 252/500

[56] References Cited

U.S. PATENT DOCUMENTS

| | | | |
|---|---|---|---|
| 3,399,995 | 9/1968 | Winchell | 96/87 |
| 3,674,711 | 7/1972 | Growald et al. | 252/500 |
| 3,786,002 | 1/1974 | Van Paesschen et al. | 252/500 |
| 3,798,032 | 3/1974 | Miller | 96/87 A |
| 3,932,179 | 1/1976 | Perez-Albeerne | 96/87 A |
| 3,958,995 | 5/1976 | Campbell et al. | 96/84 A |

*Primary Examiner*—Jack P. Brammer

*Attorney, Agent, or Firm*—Arthur H. Rosenstein

[57] ABSTRACT

Antistatic compositions comprising a highly crosslinked vinylbenzyl quaternary ammonium polymer and a hydrophobic binder are described. Elements, particularly photographic elements, having a layer of the antistatic compositions are also described. The compositions are characterized by a binder to antistatic polymer ratio of about 10:1 to 1:1. The compositions are highly conductive in thin layers and retain substantial conductivity at low relative humidity. Layers of the antistatic compositions are particularly useful for photographic elements because they can be contacted over a wide range of conditions with a hydrophilic layer without resulting in ferrotyping.

9 Claims, No Drawings

SILVER HALIDE ELEMENT WITH AN ANTISTATIC LAYER

FIELD OF THE INVENTION

The present invention relates to new antistatic compositions and to elements, particularly photographic elements, coated with these compositions. More specifically, the antistatic compositions of the present invention comprise a particulate, crosslinked, polymeric N,N,N-trialkyl-N-vinylbenzylammonium salt in combination with hydrophobic binders.

BACKGROUND OF THE INVENTION

The unwanted build-up of static electricity on an insulating support has been a continuing problem. It is well known that a thin conductive coating will prevent static build-up but while it is relatively easy to formulate a conductive composition that can be coated on a support, it has been quite difficult to combine these conductive properties with other desirable physical properties.

The stringent physical requirements for the surfaces of photographic elements make the formulation of a suitable antistatic composition for these elements particularly troublesome. Typically, the antistatic composition is coated directly on the support and on the other side of the support is coated the radiation sensitive layers. The radiation sensitive layers frequently comprise a hydrophilic binder, such as gelatin, to facilitate processing. The antistatic layer on the so called "base side" of the support must be compatible with the hydrophilic binder on the so called "emulsion side" so that when the antistatic layer contacts the hydrophilic layer, such as when the film is rolled on itself, no physical defects are produced. With the majority of antistatic compositions, an impasse is reached at this point. It is known that the ionic polymeric compounds that are frequently used antistatic agents, require the presence of moisture to provide conductivity. To allow the moisture to contact the antistatic agent it is commonly thought that any binder that is used must be hydrophilic.

It has been proposed to coat photographic elements with polymers of vinylbenzyl quaternary ammonium compounds and in U.S. Pat. No. 3,399,995 to Winchell there is described such an element. These polymers, which are crosslinked by the inclusion of a small amount (such as 5.0 to 0.01 percent by weight) of a crosslinking divinylbenzene unit in the polymer, are coated directly onto the support without the aid of a binder. While these coatings of vinylbenzyl quaternary ammonium polymers are useful in increasing the conductivity of the support, coating the antistatic polymer without the aid of a binder creates several other physical problems. For example, coatings made in the manner described in the Winchell patent tend to have poor resistance to aqueous processing compositions and cause scumming in photographic films and produce brittle layers having poor adhesion. These coatings also cause severe ferrotyping when contacted with the emulsion side of another element. In a similar patent, U.S. Pat. No. 3,001,918, L. H. Silvernail et al describe another binderless conductive coating of a vinylbenzyl quaternary ammonium compound. These coatings suffer from the same defects.

In U.S. Pat. No. 3,674,711 to Growald et al, there is described a self-supporting clear transparent sheet comprising a vinylbenzyl quaternary ammonium polymer and a binder. Again the antistatic polymer is crosslinked with only a small amount (less than 5% by weight) of divinylbenzene. While useful in forming relatively thick (10 mils) self-supporting sheets, the sheets of Growald et al are not useful for photographic elements in that said elements require thin antistatic coating layers.

In U.S. Pat. No. 3,786,002 to Paesschen et al, there is described an antistatic coating for a polyester film comprising an uncrosslinked vinylbenzyl quaternary ammonium compound along with a chlorine-containing polymer consisting of at least 70 percent by weight of vinylchloride or vinylidene chloride. The use of linear hydrophilic antistats, even if used with a hydrophobic binder, frequently results in impaired physical properties due to the migration of the antistat to the surface of the coating.

While many compositions have provided layers which significantly reduce the static susceptability of photographic elements, the antistatic component is generally coated with a hydrophilic binder. It has been found however, that in a photographic element, if a hydrophilic binder is used for an antistatic layer which comes in contact with the hydrophilic radiation sensitive layer, numerous physical problems frequently result. The two hydrophilic binder materials may stick together, cause ferrotyping or other undesirable defects.

Thus there is a continuing need for antistatic compositions which can be coated on elements to provide the necessary antistatic characteristics without deleteriously effecting the physical properties. It is desirable to have an antistatic composition that can be coated on the base side of a photographic support so that when the element is coiled or rolled on itself the antistatic layer does not stick to or ferrotype the emulsion layer. It would also be desirable to have an antistatic composition that retains substantial conductivity even at low relative humidity.

SUMMARY OF THE INVENTION

In one aspect of the present invention, there is provided an antistatic composition comprising an antistatic, highly crosslinked vinylbenzyl quaternary ammonium polymer in combination with a hydrophobic binder wherein the weight ratio of binder to antistatic crosslinked polymer is about 10:1 to 1:1. The antistatic crosslinked polymer can be represented by the formula:

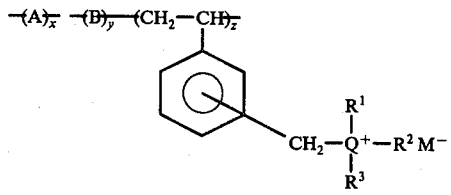

wherein A is a polymerized monomer containing at least two ethylenically unsaturated groups; B is a polymerized copolymerizable, $\alpha$, $\beta$-ethylenically unsaturated monomer;

Q is N or P;

$R^1$, $R^2$ and $R^3$ are independently selected from the group consisting of carbocyclic, alkyl, aryl and aralkyl, and wherein $R^1$, $R^2$ and $R^3$ together can form the atoms necessary to complete a heterocyclic ring with Q, such as pyridinium.

$M^-$ is an anion;

$x$ is from about 0.1 to about 20 mole percent;

$y$ is from about 0 to about 90 mole percent; and $z$ is from about 10 to about 99 mole percent. The antistatic polymer is water dispersible and is particulate in form.

Because of the high conductivity of relatively thin layers of the compositions of the present invention, they can be used to provide a wide variety of static resistant articles. Thus, in another aspect of the present invention, there is provided a support having a layer comprising the above-described antistatic composition. The elements can for example be static resistant fibers, plastic sheets, and the like. The resistivity of the compositions of the present invention are typically on the order of $10^8$–$10^9$ (at 50% R.H.) ohms/square when the composition is coated on a support at a coverage of about 0.25 g/m$^2$ on the support.

The highly crosslinked antistatic polymer can be coated in thin layers with a hydrophobic binder and still retain its conductive properties. The compositions of the present invention are therefore particularly useful in forming antistatic layers for photographic elements. Thus, in a preferred embodiment of the present invention, there is provided a photographic element comprising a support having an antistatic layer coated thereon comprising the antistatic composition of the invention coated at a total coverage of antistatic polymer and binder of about 0.25 g/m$^2$ to 20 g/m$^2$. In a highly preferred aspect of the present invention, there is provided a photographic element comprising a support having coated on one side as the outermost layer a layer comprising a hydrophilic polymer and having coated on the other side as the outermost layer an antistatic layer comprising the composition of the present invention coated at a total coverage of antistatic polymer and binder of about 0.25 g/m$^2$ to 20 g/m$^2$.

It has been surprisingly found that not only will the highly crosslinked vinylbenzyl quaternary ammonium containing polymer retain its antistatic properties when coated with a hydrophobic binder, but that the humidity dependence of the resistivity of such an antistatic composition is less than would be expected. In other words, in comparison to the other prior art anionic or cationic polymer compositions, the compositions of the present invention retain a surprising amount of conductivity at low humidity.

The hydrophobic binder — highly crosslinked antistatic polymer compositions of the present invention are highly resistant to sticking and ferrotyping in photographic elements. That is, the antistatic layer of one photographic element may be placed in contact with the emulsion layer of another photographic element, incubated under relatively high temperature and humidity conditions without adversely effecting the emulsion layer. This is a highly advantageous property of a photographic film which is to be rolled on itself or stacked without any interleaving protection. Certain embodiments of the present invention have been found to be particularly useful in that they form substantially haze free conductive coatings. This is important because it allows the formation of transparent static resistant elements. The compositions are also particularly useful in photographic elements because the antistatic polymer does not adversely affect the sensitometric properties of silver salt emulsions. The antistatic polymer may also survive photographic processing thereby providing antistatic protection to the processed element, however, in many instances, it is desirable to overcoat the antistatic layer with a layer protecting it from processing conditions.

DESCRIPTION OF THE PREFERRED EMBODIMENTS

Preferred antistatic polymers according to this invention comprise units having the formula above wherein A is a repeating unit of an addition polymerizable monomer containing at least 2 ethylenically unsaturated groups, such as vinyl groups generally having the structure

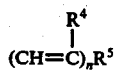

wherein $n$ is an integer greater than 1 and preferably 2 or 3; $R^4$ is selected from hydrogen and methyl and $R^5$ is a linking group comprising 1 or more condensation linkages such as an amide, a sulfonamide, an ester such as sulfonic acid ester, and the like, or a condensation linkage and an organic nucleus, including an alkylene group, such as methylene, ethylene, trimethylene; an arylene group, such as phenylene and others such as phenylenedi(oxycarbonyl), 4,4'-isopropylidene bis(-phenyleneoxycarbonyl), methylenedi(oxycarbonyl), ethylenedi(carbonyl), 1,2,3-propanetriyltris-(oxycarbonyl), cyclohexylenebis(methyleneoxycarbonyl), methyleneoxymethylenedi(carbonyloxy), ethylenebis(oxyethleneoxycarbonyl), ethylidyne trioxycarbonyl, and the like. The monomer (A) used must be stable in the presence of strong alkali and must not be highly reactive so that substantial hydrolysis does not occur during copolymerization.

Suitable examples of monomers from which the repeating units (A) are formed are divinylbenzene, allyl acrylate, allyl methacrylate, N-allylmethacrylate, 4,4'-isopropylidenediphenylene diacrylate, 1,3-butylene diacrylate, 1,3-butylene dimethacrylate, 1,4-cyclohexylenedimethylene dimethacrylate, diethylene glycol dimethacrylate, diisopropylidene glycol dimethacrylate, divinyloxymethane, ethylene diacrylate, ethylene dimethacrylate, ethylidene diacrylate, ethylidene dimethacrylate, 1,6-diacrylamidohexane, 1,6-hexamethylene diacrylate, 1,6-hexamethylene dimethacrylate, N,N'-methylenebisacrylamide, 2,2-dimethyl-1,3-trimethylene dimethacrylate phenylethylene dimethacrylate, tetraethylene glycol dimethacrylate, tetramethylene diacrylate, tetramethylene dimethacrylate, 2,2,2-trichloroethylidene dimethacrylate, triethylene glycol diacrylate, triethylene glycol dimethacrylate, ethylidyne trimethacrylate, propylidyne triacrylate, vinyl allyloxyacetate, vinyl methacrylate, 1-vinyloxy-2-allyloxyethane, and the like. Ethylene glycol dimethacrylate is a particularly preferred monomer.

B is a unit of a copolymerizable $\alpha$, $\beta$-ethylenically unsaturated monomer (including two, three or more units) such as ethylene, propylene, 1-butene, isobutene, 2-methylpentene, 2-methylbutene, 1,1,4,4-tetramethylbutadiene, styrene, alpha-methylstyrene; monoethylenically unsaturated esters of aliphatic acids such as vinyl acetate, iospropenyl acetate, allyl acetate, etc.; esters of ethylenically unsaturated mono- or dicarboxylic acids such as methyl methacrylate, ethyl arcylate, diethyl methylenemalonate, etc.; monoethylenically unsaturated compounds such as acrylonitrile, allyl cyanide, and dienes such as butadiene and isoprene. A preferred class of ethylenically unsaturated monomers which may be used to form the ethenic polymers of this invention includes the lower 1-alkenes having from 1 to 6 carbon atoms, styrene, and tetramethylbutadiene and methyl methacrylate.

$R^1$, $R^2$ and $R^3$ are each independent groups selected from the group consisting of carbocyclic preferably containing from 3 to 10 carbon atoms including aryl, aralkyl and cycloalkyl such as benzyl, phenyl, p-methylbenzyl, cyclohexyl, cyclopentyl and the like, and alkyl preferably containing from 1 to 20 carbon atoms, such as methyl, ethyl, propyl, isobutyl, pentyl, hexyl, heptyl, decyl and the like. In the preferred embodiment $R^1$, $R^2$ and $R^3$ are methyl.

$M^-$ is an anion, i.e., a negative salt forming an anionic radical or atom such as a halide (e.g., bromide, chloride), sulfate, alkyl sulfate, alkane or arene sulfonate (for example, a p-toluenesulfonate), acetate, phosphate, dialkyl phosphate or similar anionic moiety.

Q is N or P and $x$ is from about 1 to about 20 mole percent and preferably from about 5 to 10 mole percent; $y$ is from about 0 to about 90 mole percent and preferably from about 0 to 45 mole percent and $z$ is from about 10 to about 99 mole percent, preferably from about 40 to 99 mole percent.

The polymeric materials according to this invention can be prepared by emulsion polymerizing a vinylbenzyl halide with a poly unsaturated monomer A as described above and an $\alpha$, $\beta$-ethylenically unsaturated monomer B as described above, generally in the presence of an anionic surfactant such as sodium lauryl sulfate,

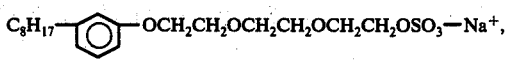

the sodium salt of a sulfated condensate of an alkylphenol and ethylene oxide (Alipal from General Dyestuff Corp.), and the like and a redox free radical initiator such as potassium persulfate-sodium bisulfite, potassium persulfate-$Fe^{+2}$, $H_2O_2$-$Fe^{+2}$ and the like. This process is described, for example, in U.S. Pat. No. 3,072,588.

The above polymeric vinylbenzyl halide latex can be reacted with a tertiary amine or tertiary phosphine having the structure:

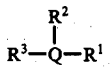

wherein $R^1$, $R^2$, $R^3$ and Q are as described above, generally at temperatures of from about −20° C to about 150° C. This produces a polymeric microgel latex which has a particulate character.

An alternate method of preparing the polymer is to emulsion polymerize a N-vinylbenzyl-N,N-disubstituted amine monomer with monomers A and B as described above in the presence of an anionic surfactant and a redox free-radical initiator. The resulting polymer tertiary amine latex is reacted with an alkylating agent having the structure $R^3$-M wherein $R^3$ is as described above and M is a group which can be displaced to yield the anion $M^-$, preferably $M^-$ is a halide such as chloride or an alkyl or aryl sulfonate group. This reaction can take place at temperatures from about −20° C to about 150° C.

In formulating the polymer by the methods described above, hydrolysis of the reactive vinylbenzyl halide residues with the liberation of HCl can produce some recurring units of the structure

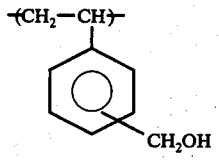

These recurring units are generally present only up to about 5 mole percent of the polymer.

The water-dispersible particulate polymers herein generally have a particle size range of from about 0.04 $\mu$ to about 0.15 $\mu$. In the preferred embodiment, a particle size range of from 0.06 $\mu$ to 0.08 $\mu$ is used.

The term "water-dispersible polymers" as used throughout the specification and claims includes polymers which appear as a clear or only slightly cloudly solution on visual inspection but which can be seen to be in particulate dispersion from when examined under an electron microscope.

The polymers are prepared quite easily as the entire preparation can take place in one pot. There is no necessity to use large amounts of solvents. The resulting polymer typically is not completely quaternized. Generally, the mole percent quaternization is from about 80 to about 100 percent.

Polymers which illustrate preferred antistatic polymers of the invention include:

copoly[N-vinylbenzyl-N,N,N-trimethylammonium chloride-coethylene glycol dimethacrylate] (93:7)*(referred to in the examples which follows as VAEG (93:7), copoly[N-vinylbenzyl-N,N,N-trimethylammonium chloride-co-ethylene glycol diacrylate] (90:10), copoly[N-vinylbenzyl-N,N,N-triethylammonium chloride-co-ethylene glycol dimethacrylate] (93:7), and copoly[styrene-co-N-vinylbenzyl-N,N,N-trimethylammonium chloride-co-divinylbenzene] (20:70:10).

* As used herein the numbers in the parenthesis indicate the molar ratio of monomers in the copolymer.

Preferred polymeric antistatic compositions shown in Table I have the following formula:

Table I

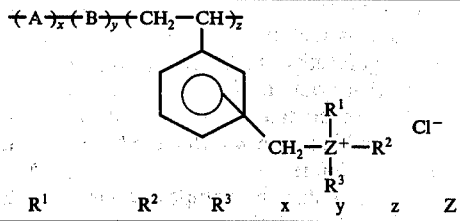

| B | $R^1$ | $R^2$ | $R^3$ | x | y | z | Z | A |
|---|---|---|---|---|---|---|---|---|
| — | $CH_3$ | $CH_3$ | $CH_3$ | 5 | — | 95 | N | divinylbenzene |
| — | | pyridinium | | 5 | — | 95 | N | " |

Table I-continued

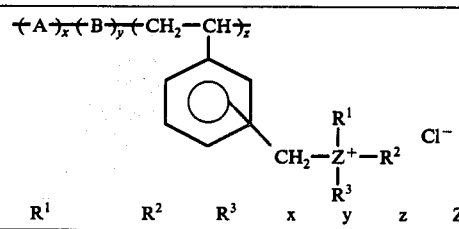

| B | $R^1$ | $R^2$ | $R^3$ | x | y | z | Z | A |
|---|---|---|---|---|---|---|---|---|
| — | $CH_3$ | $CH_3$ | $CH_3$ | 2 | — | 98 | N | " |
| styrene | $CH_3$ | $CH_3$ | $CH_3$ | 5 | 47.5 | 47.5 | N | " |
| styrene | n-Butyl | n-Butyl | n-Butyl | 2 | 49 | 49 | P | " |
| — | n-Butyl | n-Butyl | n-Butyl | 5 | — | 95 | P | " |
| styrene | $-N^+(CH_3)_2-CH_2CH(OH)-CH_2N(CH_3)_3$ $Cl^-$ $Cl^-$ | | | 2 | 49 | 49 | N | " |
| — | $-N^+(CH_3)_2-CH_2CH(OH)-CH_2N(CH_3)_3$ $Cl^-$ $Cl^-$ | | | 5 | — | 95 | N | divinylbenzene |
| hexafluorobutyl methacrylate | $CH_3$ | $CH_3$ | $CH_3$ | 2 | 18 | 70 | N | " |
| methyl methacrylate | $CH_3$ | $CH_3$ | $CH_3$ | 5 | 5 | 90 | N | " |
| methyl methacrylate | $CH_3$ | $CH_3$ | $CH_3$ | 5 | 10 | 85 | N | " |
| n-butyl acrylate | $CH_3$ | $CH_3$ | $CH_3$ | 5 | 5 | 90 | N | " |
| n-butyl acrylate | $CH_3$ | $CH_3$ | $CH_3$ | 5 | 10 | 85 | N | " |
| — | $-CH_2CH_2OH$ | $CH_3$ | $CH_3$ | 5 | — | 95 | N | divinylbenzene |
| — | $CH_3$ | $CH_3$ | $CH_3$ | 10 | — | 90 | N | " |
| styrene | $CH_3$ | $CH_3$ | $CH_3$ | 4 | 20 | 76 | N | " |
| — | $CH_3$ | $CH_3$ | $CH_3$ | 7 | — | 93 | N | ethylene glycol dimethacrylate |

Polymers that are similar to those useful herein are described in U.S. Pat. No. 3,958,995 as being useful as an acid dye mordant in a photographic element comprising an acid dye. Similar polymers are also described in copending U.S. Patent Application Ser. No. 631,800 to Holmes and Campbell where their use in a photographic element as a developer inhibitor scavenger is described. Both where the polymers are to be used as mordants and developer inhibitor scavengers, the polymers are included in relatively high coverages and in conjunction with hydrophilic binders. Further, when the polymers are to be used for mordants or scavengers, they are considered useful when they contain an amount of crosslinking agent of from about 0.25 to about 5 mole percent. The antistatic polymers useful in the present invention are preferably more crosslinked. That is they contain from about 1 up to about 20 mole percent of a crosslinking monomer but preferably from about 5 to 10 mole percent.

The antistatic compositions of the present invention are prepared merely by dispersing the crosslinked polymer in a hydrophobic binder. Any hydrophobic binder that is compatible with the crosslinked polymer is suitable. Particularly useful binders are cationic or neutral hydrophobic binders such as acetylated cellulose, poly(methylmethacrylate), poly(ethylacrylate), poly(styrene), poly(butyl methacrylate-co-styrene) (60:40), poly(vinylacetal), cellulose acetate buryrate and the like. By the term hydrophobic it is meant that the binder is not water-soluble or swellable.

Where the element onto which the composition is to be coated is to remain substantially transparent, the binder-antistatic polymer combination should be chosen to form a clear coating composition which forms a substantially haze-free coating.

Whether a haze-free coating will be formed depends on the particular support — antistatic composition and may be determined by simple experiment. A coating composition is prepared using 4 parts of the chosen binder to 1 part of the chosen antistatic polymer. Sufficient solvent for the binder is added to form a coating composition that is 2.5% by weight binder-antistatic polymer. The composition is hand coated to a coverage of 1 to 2 g/m$^2$ on the chosen support and dried at 180° C for 5 minutes. Visual inspection of the dried sample is usually sufficient to determine the suitability of the combination. Alternatively the haze may be determined by measuring the amount of scattered light on a spectrophotometer and the composition is considered substantively haze-free if the haze is less than 1%.

Where the antistatic layer is to be on an opaque support such as paper for example, the binder-antistatic composition need not form a haze-free coating. In this embodiment, the binder may itself be opaque.

Whether the composition is on a clear or opaque support, it may contain any of a wide variety of addenda which do not affect the antistatic polymer. Typical addenda include matting agents, surfactants and lubricants.

The particular solvent for forming the dispersion of the antistatic polymer in binder depends on the particular binder chosen. Generally, the solvent must both disperse the antistatic polymer and dissolve the binder.

Relatively hydrophilic solvents such as methanol or 2-methoxyethanol will disperse the antistatic polymers and mixtures of solvents may be desirable to also dissolve the binders. Typical solvents include acetone, methanol, propylene chloride, methanol-methyl chloroform, ethanol-methylene chloride, isopropanol-dimethylformamide, methanol-2-butanone, 2-methoxyethanol and the like. As seen from the above list, mixtures of two or more solvents can also be used to advantage. It is frequently advantageous to choose a solvent or solvent mixture that will not only dissolve the binder but will also partially dissolve or soften the support onto which the antistatic layer is to be applied. Adhesion of the antistatic layer can be increased by such a solvent without decreasing the antistatic properties of the composition. Preferred support-solvent combinations include cellulose acetate with acetone/methanol and with methanol/propylene chloride/2-methoxyethanol.

In order to achieve the desired physical properties for the antistatic composition the weight ratio of the hydrophobic binder to the antistatic polymer should be between about 10:1 to 1:1. Particularly advantageous compositions are formed where the weight ratio of hydrophobic binder to antistatic polymer is about 5:1 to 2:1. Sufficient solvent can be added to the binder-antistatic polymer composition to facilitate coating. Typically, the coating composition can comprise from about 0.2 weight percent up to 20 weight percent of the binder-antistatic polymer composition, the remainder being the solvent.

The coating compositions as described above may be coated on any of a wide variety of supports to provide useful articles that are resistant to static such as electrophotographic systems, electrically amplified recording systems and photographic films. The support can comprise for example any photographic support material such as paper, baryta coated paper, resin coated paper, pigment coated polymeric film, poly(ethylene terephthalate), cellulose acetate, glass, polycarbonates and the like such as described in *Product Licensing Index,* Vol. 92, Dec. 1971, publication 9232, pages 107–110. The antistatic layers can be coated by any of a wide variety of methods known in the art including spraying, dipping, slide hopper coating and the like.

In order to achieve sufficient conductance and the desired physical properties, the total coverage of the hydrophobic binder-antistatic polymer should be at least about 0.25 g/m$^2$. For economy and also to achieve the desired physical properties the total coverage should be less than 10 g/m$^2$. The preferred coverage is between about 0.5 and 1.0 g/m$^2$. What is meant by "total coverage" is the sum of the coverages for the antistatic polymer and binder. It is to be understood that the coverage for the antistatic layer may be greater due to the presence of other components in the composition.

The antistatic compositions may be coated in any of a wide variety of locations in a photographic element. For example, the antistatic layer may be between the support and the radiation sensitive layers. Alternatively, where the radiation sensitive layers do not require aqueous solution development the antistatic compositions of the present invention may be coated over the top of these layers. For antistatic backings, it is also common practice to overcoat the antistatic layer with additional addenda such as lubricants, antihalation layers, or other polymer layers to achieve desired properties required for many photographic applications. In a highly preferred embodiment of the present invention, the radiation sensitive layers, with an outermost hydrophilic layer, are coated on one side of the photographic support while the antistatic compositions of the invention are coated on the other side of the support. The radiation sensitive layer itself may be the hydrophilic layer or the layer may be overcoated with a hydrophilic layer. This outermost hydrophilic layer may also contain a variety of addenda such as matting agents, antifoggants, plasticizers, haze reducing agents and the like. The outermost hydrophilic layer can comprise any of a large number of water permeable hydrophilic polymers that are well known in the art. Typical hydrophilic polymers include gelatin, albumin, polyvinyl alcohols, agar agar, sodium alginate, hyrolyzed cellulose esters, hydrophilic polyvinyl copolymers and the like.

The antistatic composition can be coated directly on the opposite side of the support or may be coated over any of a wide variety of subbing layers known in the art. Typical subbing layers include copoly(vinylidene chlorideacrylonitrile-acrylic acid), cellulose nitrate and other cellulose derivatives.

The radiation sensitive layers of the elements of the present invention can take a wide variety of forms. The layers can comprise photographic silver salt emulsions, such as silver halide emulsions; diazo type compositions; vesicular image forming compositions; photopolymerizable compositions; and the like.

Photographic silver halide emulsions useful in our invention comprise any of the ordinarily employed silver halide developing-out emulsions, such as silver-chloride, -chlorobromide, -chloroiodide, -chlorobromoiodide, -bromide and -bromoiodide emulsions.

Photographic silver halide emulsions useful in our invention can also contain such addenda as chemical sensitizers, development modifiers, antifoggants, and the like. Examples of these can be found in *Product Licensing Index,* Publication 9232, Vol. 92, December 1971. pp. 107–110.

The emulsions may also be chemically sensitized with reducing agents such as stannous salts (Carrol U.S. Pat. No. 2,487,850), polyamines such as diethylene triamine (Lowe and Jones, U.S. Pat. No. 2,518,698), polyamines such as spermine, (Lowe and Allen U.S. Pat. No. 2,521,925), or bis- ($\beta$- aminoethyl) sulfide and its water-soluble salts (Lowe and Jones U.S. Pat. No. 2,521,926), sulfur sensitizers (e.g., allyl thiocarbamate, thiourea, allyl isothiocyanate, cystine, etc.), various gold compounds (e.g., potassium chloroaurate, auric trichloride, etc. See U.S. Pat. Nos. 2,540,085; 2,597,856; and 2,597,915, etc.).

The emulsions according to the invention can also contain speed-increasing compounds of the quaternary ammonium type as described in U.S. Pat. Nos. 2,271,623, issued Feb. 3, 1942; 2,288,226, issued June 30, 1942; 2,334,864, issued Nov. 23, 1943; or the thiopolymers as described in Graham et al, U.S. Pat. No. 3,046,129; and Dann et al, U.S. Pat. No. 3,046,134.

The emulsions may also be stabilized with mercury compounds and the like such as described in Allen, Byers and Murray U.S. Pat. No. 2,728,663; Carroll and Murry U.S. Pat. No. 2,728,664; and Leubner and Murray U.S. Pat. No. 2,728,665.

The following examples are submitted to illustrate the practice of the invention and are not intended to limit the invention in any way.

EXAMPLES 1 - 2

Two dispersions of the antistatic polymer VAEG (93:7) and the binder 39% acetylated cellulose in a solvent containing 55% acetone and 45% methanol were prepared in the proportions given in Table II. The dispersions were coated on a cellulose triacetate support to a coverage of 0.6 g/m$^2$. The surface resistivity was measured for these coatings as well as an uncoated sample of the support. The resistivity was measured on the coated side of the support at 50% R.H. 70° C using the method described in Nadeau et al, U.S. Pat. No. 2,801,191. The single arm scratch (SAS), abrasion resistance and ferrotyping tests were performed on these samples with the indicated results.

The single arm scratch test determines the effect on processed film of abrasion in the raw state. Samples of film are conditioned for at least 2 hours at 70° F and 50% relative humidity and placed on a glass slide, test side up. A weight of gradually increasing loads is placed on a stylus and after each weight, the stylus is moved laterally. After each sample is abraded, the scratched samples after fixing are mounted for evaluation by projection. The samples are projected with a Kodak 500 projector on a screen using a distance of 4 feet. Scratch observances are noted at 4 foot viewing distance, 15 foot viewing distance and the first plowing at the 4 foot distance. The weights to produce the lines as viewed are recorded. The averages of the weights required to produce the first visible lines as observed at 4 and 15 feet and the first plowing at 4 feet are calculated and rounded to the nearest 5 grams.

The ferrotyping test is to determine the effect on an emulsion of winding it under tension in contact with the back surface. Two strips representing each emulsion variable are kept at 70° F and 50% relative humidity to be used as processed originals. Two holes, one quarter inch in diameter spaced three inches apart, are punched in the center of each strip. Four strips each of the emulsion and backing test variables are conditioned overnight on pin racks at 60% relative humidity and 70% relative humidity at 70° F in photographic darkness. Three hundred foot rolls of clear leader are conditioned to the same relative humidities as the test strips.

After conditioning, 50 feet of the leader are wound on a 35 mm core at 24 ounces tension. Two test strips, representing the backing and emulsion variables, are placed in emulsion to backing contact and wound into the roll. The sets of strips in each roll are spaced about 2 feet apart. The rolls are placed in conditioned black paper bags and sealed in cans with 2 layers of tape for keeping periods of 3 days at 120° F and 7 days at 100° F. After keeping the strips are cut to 12 inch lengths and punched for sensitometric processing. The two original and two test strips are flashed to a medium density followed by processing. Ferrotyping is reported as excellent, good, moderate or poor.

The abrasion is measured by the following carborundum test. This measures the comparative values of the abrasion resistance of film base.

Two 2 inch square samples are kept overnight at 70° F and 50% relative humidity. After conditioning, the squares are fastened to a platform. Four hundred grams of #80 carborundum (silicon carbide grain) is weighed out and the hopper and platform are revolved wherein the carborundum is poured into the hopper and allowed to fall on the square. After all the carborundum has dropped, the sample is removed and tapped gently to remove particles of abrasive. The samples are interleaved with bond paper until they can be read on the Lumetron Colorimeter. Two standard check samples are run with every test. The abrasion or % haze is calculated by multiplying the $$\frac{\text{A reading} - \text{B reading}}{\text{A-reading}}$$

by 100.

Table II

| Example | Antistatic Coating | Surface Resistivity | SAS | Abrasion (% Haze) |
|---|---|---|---|---|
| Control | Support with no coating | $>10^{12}$ ohms/sq. | 70 | 58.8 |
| 1 | 2% of a 39% acetylated cellulose and 0.5% VAEG (93:7) antistatic polymer | $5.0 \times 10^8$ ohms/sq. | 100 | 62.4 |
| 2 | 1% of a 39% acetylated cellulose and 0.4% VAEG (93:7) antistatic polymer | $4.6 \times 10^8$ ohms/sq. | 100 | 59.5 |

The results show that the antistatic compositions of the invention form elements having a resistivity that is decreased by about a factor of $10^5$ in comparison to an uncoated support, without seriously affecting the elements' resistance to scratching or abrasion.

EXAMPLES 3–9

COMPARATIVE EXAMPLES 10–14

A series of coatings were made using the various coating compositions described in Table III. The following is a key for interpreting the entries in the Table:

Support — Acetate represents cellulose triacetate; Estar is poly(ethylene terephthalate)

Binder — 39% cell represents 39% acetylated cellulose;

Formvar is a poly(vinyl acetal); Elvacite is a poly(methyl methacrylate); and PVA is a poly(vinyl alcohol).

Antistatic Polymer — VAEG (93:7) is described above;

PVBTM is the uncrosslinked polymer poly(vinylbenzyltrimethyl ammonium chloride).

Solvent — a) acetone; b) methanol; c) propylene chloride; d) methoxyethanol. Numbers below the solvent designation indicate the weight percentage of the respective solvents.

Binder/Antistat — Indicates the weight percentage of the respective component in the coating composition.

Resistivity — This indicates the resistivity of the coated side of the support in ohms/sq $\times 10^{-8}$ measured at 70° C, 50% R.H. by the method of Nadeau et al described above.

Ferrotyping — This represents the propensity for the coated side of the support to cause ferrotyping (polishing of the emulsion surface) when it is contacted with the emulsion side of another element which has a color negative emulsion in a hydrophilic binder coated thereon. The data represents an average of four separate tests where the contacted samples are incubated at 100° C–60% R.H. for 7 days; 120° C–60% R.H. for 3 days; 100° C–70% R.H. for 7 days; and 120° C–70% R.H. for 3 days.

In each case the total coverage of antistatic polymer and binder was about 0.5 g/m$^2$.

The data show that the crosslinked polymer without a binder (ex. 12) is unacceptable because of moderate to poor ferrotyping. The uncrosslinked polymer with a hydrophobic binder (ex. 14) has excellent ferrotyping characteristics but lower than desired conductivity and unacceptable haze. This indicates that the crosslinked polymers were superior in properties to the linear polymers and that binders are necessary to achieve acceptable results. It is also seen that the hydrophobic binders yield far better results than do hydrophilic binders and that the antistatic compositions can be coated over a wide variety of substrates.

Table III

| Example | Support | Binder | Antistatic Polymer | Solvent | Binder/ Antistat | Resistivity (ohm/sq × $10^{-8}$ | Ferro-Typing | Other |
|---|---|---|---|---|---|---|---|---|
| 3 | acetate | 39% cell. | VAEG (93.7) | a/b 55/45 | 2.0/0.4 | 10.0 | excellent | clear |
| 4 | same | same | same | same | 2.0/0.6 | 3.0 | excellent | mostly clear |
| 5 | same | same | same | same | 2.0/1.0 | .9 | moderate | clear |
| 6 | same | Formvar | same | same | 2.0/0.6 | 4.0 | good | moderate haze |
| 7 | same | Elvacite | same | b/c/d 40/30/30 | 2.0/0.6 | not tested | not tested | |
| 8 | same | ASB | same | b | 2.0/0.6 | not tested | not tested | |
| 9 | Estar | Elvacite | same | b/c/d 25/60/15 | 2.0/0.6 | not tested | not tested | |
| The following are comparative examples | | | | | | | | |
| 10 | acetate | — | — | — | — | $>10^{12}$ | excellent | |
| 11 | acetate | — | same | a/b 55/45 | /0.6 | 2.0 | poor | hazy |
| 12 | acetate | — | PVBTM | same | /0.6 | 120 | poor | |
| 13 | same | 39% cell PVBTM | same | 2.0/0.6 | 20 | excellent | hazy | |
| 14 | same | Elvacite | same | b/c/d 40/30/30 | 2.0/0.6 | ∞ | good | hazy |

The invention has been described in detail with particular reference to preferred embodiments, but it will be understood that variations and modifications can be effected with departing from the spirit and scope of the invention.

What is claimed is:

1. A photographic element comprising a support having coated on one side a radiation sensitive silver halide layer or layers and coated on the other side an antistatic layer comprising:

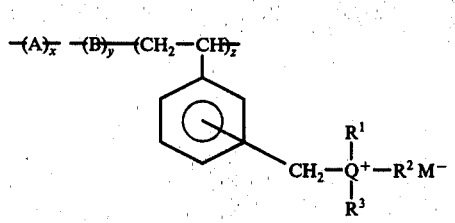

wherein:

A represents units of an addition polymerizable monomer containing at least two ethylenically unsaturated groups;

B represents units of a copolymerizable $\alpha,\beta$-ethylenically unsaturated monomer;

Q is N or P;

$R^1$, $R^2$ and $R^3$ are independently selected from the group consisting of carbocyclic and alkyl groups;

M is an anion;

$x$ is from about 0.1 to about 20 mole percent;

$y$ is from about 0 to about 90 mole percent; and $z$ is from about 10 to about 99 mole percent and a polymeric hydrophobic binder wherein the weight ratio of said hydrophobic binder to said antistatic polymer is about 5:1 to 2:1 and wherein the total coverage of said antistatic polymer and said binder is about 0.25 g/m² to 20 g/m².

2. An element according to claim 1 wherein the total coverage of said antistatic polymer and said binder is about 0.5 g/m² to 1.0 g/m².

3. A photographic element of claim 1 wherein $x$ is from about 5 to 10 mole percent.

4. A photographic element of claim 1 wherein A is a unit of ethylene glycol dimethacrylate.

5. A photographic element of claim 1 wherein $R^1$, $R^2$ and $R^3$ are methyl.

6. A photographic element of claim 1 wherein said antistatic polymer is copoly[N-vinylbenzyl-N,N,N-trimethylammonium chloride-co-ethylene glycol dimethacrylate] (93:7).

7. A photographic element of claim 1 wherein said hydrophobic binder is selected from the group consisting of acetylated cellulose, poly(methylmethacrylate) and poly(vinyl acetal).

8. A photographic element of claim 1 wherein said support is a cellulose acetate and wherein said hydrophobic binder is an acetylated cellulose.

9. A photographic element of claim 1 wherein said antistatic polymer is copoly[N-vinylbenzyl-N,N,N-trimethylammonium chloride-co-ethylene glycol dimethacrylate] (93:7) and said hydrophobic binder is 39% acetylated cellulose.

* * * * *